United States Patent [19]

Wicks

[11] Patent Number: 4,679,265

[45] Date of Patent: Jul. 14, 1987

[54] LIFT DEVICE FOR AN INCUMBENT PERSON

[76] Inventor: Jack W. Wicks, 9425 Blind Pass Rd., #1007, St. Petersburg Beach, Fla. 33706

[21] Appl. No.: 781,405

[22] Filed: Sep. 27, 1985

[51] Int. Cl.[4] ..... A61G 7/06

[52] U.S. Cl. ..... 5/445; 5/508; 24/72.5

[58] Field of Search ..... 5/445, 503, 504, 443, 5/444, 508; 272/112; 128/31, 75; 24/72.5; 182/5, 206

[56] References Cited

U.S. PATENT DOCUMENTS

| | | | |
|---|---|---|---|
| 667,621 | 2/1901 | Fleming | 128/31 |
| 816,697 | 4/1906 | Williams | 5/432 |
| 905,301 | 12/1908 | English | 128/31 |
| 908,845 | 1/1909 | Curtin | 5/445 |
| 1,676,061 | 7/1928 | Strom | 272/112 |
| 2,057,811 | 10/1936 | Armstrong | 5/445 |
| 2,216,876 | 10/1940 | Crum | 248/74.2 |
| 2,585,660 | 2/1952 | Kjos et al. | 5/445 |
| 2,843,858 | 7/1958 | Bjorklund | 5/445 |
| 2,927,329 | 3/1960 | Johannis | 5/445 |
| 3,523,310 | 8/1970 | Shead | 5/444 |
| 3,907,118 | 9/1975 | Pelavin | 248/214 |
| 4,141,524 | 2/1979 | Corvese | 5/503 |
| 4,561,549 | 12/1985 | Yokohori | 211/182 |

FOREIGN PATENT DOCUMENTS

| | | | |
|---|---|---|---|
| 362892 | 11/1921 | Fed. Rep. of Germany | 5/445 |
| 351729 | 7/1905 | France | 5/445 |
| 14985 | 3/1912 | France | 128/31 |
| 64579 | 3/1913 | Switzerland | 5/445 |
| 5405 | of 1909 | United Kingdom | 5/445 |
| 5726 | of 1910 | United Kingdom | 5/445 |

*Primary Examiner*—John E. Murtagh
*Assistant Examiner*—Andrew Joseph Rudy
*Attorney, Agent, or Firm*—Peterson, Wicks, Nemer & Kamrath

[57] ABSTRACT

A lift device for an incumbent person for use with a mattress independent of bed construction and including a rigid hook member, the opening of the hook of a dimension substantially equal to the thickness of a mattress whereby the hook member is tightly engageable with a mattress, and a tether connected to the hook member and extending therefrom for grasping by a user.

7 Claims, 5 Drawing Figures

LIFT DEVICE FOR AN INCUMBENT PERSON

PRIOR ART KNOWN TO APPLICANT

| | |
|---|---|
| U.S. Pat. No. 908,845 | |
| U.S. Pat. No. 2,927,329 | |
| U.S. Pat. No. 2,585,660 | |
| U.S. Pat. No. 2,843,858 | |
| U.S. Pat. No. 816,697 | |
| U.S. Pat. No. 2,057,811 | |
| Foreign | |
| Great Britain No. 5405 | 3/5/09 |
| Great Britain No. 5726 | 3/10/09 |
| French No. 351,729 | 5/12/05 |
| Swiss No. 64579 | 3/6/13 |
| Germany No. 362,892 | 11/2/22 |

SUMMARY

The present invention relates broadly to an aid for a person having limited ability to raise one's body from a recumbent position on a bed mattress to substantially an upright sitting position thereon whereby the person may easily remove themselves from the mattress over the side. The aid device requires no adaptation to or connection with a bed or any part thereof and is therefore universally useable with virtually all mattresses. The device may also be used to lower one's self from an upright position to a prone position. It is simply and easily placed in operative position on the mattress for easy use and is easily removed and stored when not in use.

More particularly the invention relates to an improvement in an aid which includes a substantially rigid member for engagement with the foot end of a mattress independent of the mattress support or the bed construction, the engaging member being in the form of a substantially rigid hook which is substantially U-shaped with the opening of the hook between the legs of the hook substantially the same dimension as the thickness of the mattress and having a tether connected thereto and extending therefrom for initial grasping by the user from substantially a prone position. The tether has at least one extended portion thereon for easy gripping by the user.

As one example of use, after a surgical operation in the area of the stomach or corresponding side and back areas acute pain is endured in the area of the surgery during the first week or two after surgery when the bedridden patient raises himself up from a prone position to an upright sitting position on the mattress without help which position is necessary as a preliminary step to getting out of bed, whereby the patient can swing his legs over the side of the bed and get out of bed with further pulling on the tether if necessary. The device can be of great aid to the elderly and those with other forms of handicap.

In use of the device the engagement hook member is engaged with the foot end of a mattress preferably over top of the mattress covering with the tether overlying the top of the bed covering and extending longitudinally thereof towards the head of the bed for easy grasp by a patient lying on the bed. Due to the formation of the hook member it tightly engages the mattress. A patient lying on the bed grasps and pulls on the tether whereby he can easily pull himself up to an upright sitting position without a strain on the surgery area and thus substantially free of pain. In the event the patient has a problem in lowering himself into bed he may use the device.

From an upright position the patient can swing his legs over the side of the bed and get off the bed. With use of this device the patient does not have to enlist the services of a nurse or other person, thus freeing a nurse and others for other pressing duties.

The device is a valuable aid to anyone bedridden with a problem in raising from an incumbent position to an upright position preparatory to getting out of bed over the side.

It has been found that by far the greater proportion of mattresses are of substantially the same thickness and therefore this device can pretty well be universally used, and in any instance with no need for any form of mechanism for adaptation to a bed or mattress support, for the device operates solely in conjunction with a mattress.

When not in use, the device lies upon the top of the bed covering and does not interface with any portion or operation of the bed. The device is simply removed from the end of the mattress and easily stored with the tether folded up upon the engagement hook.

Objects and advantages other than those above set forth will be apparent to those skilled in the art from the following description when read in connection with the accompanying drawings.

In the drawings forming part of this application:

Figure 1:
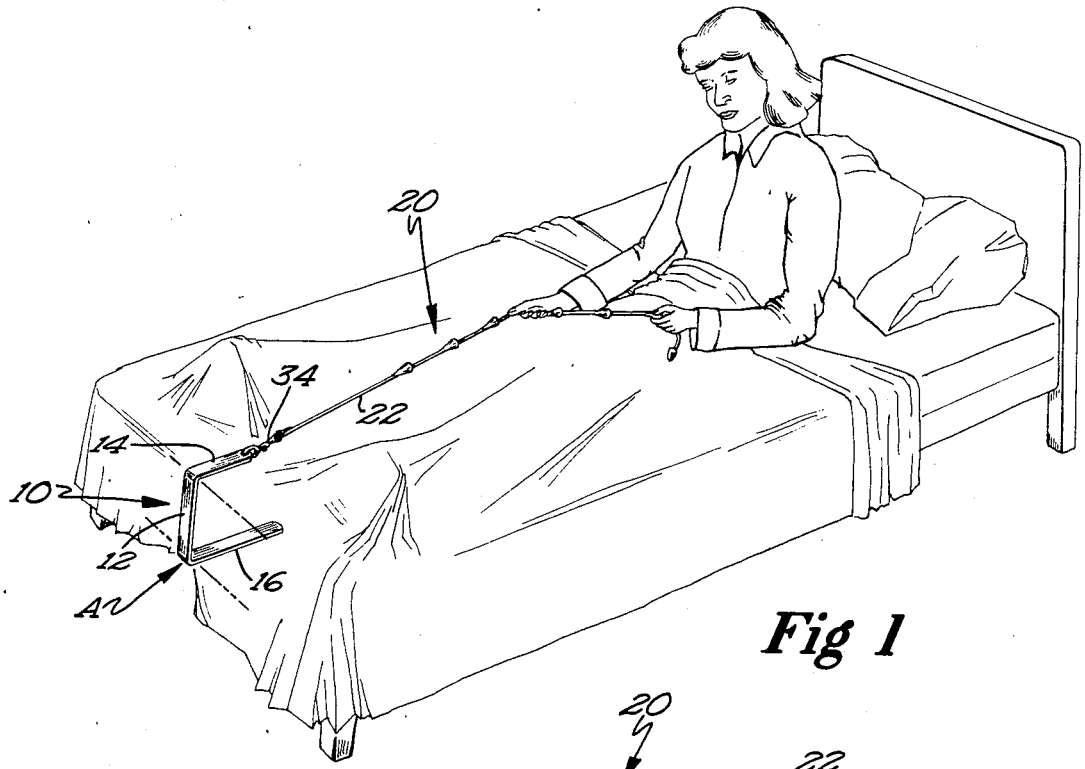
FIG. 1 is a perspective view of a bed with the lift device in operative position on a mattress and showing a person on the mattress pulling herself up towards an upright position be means of the device.
Figure 2:
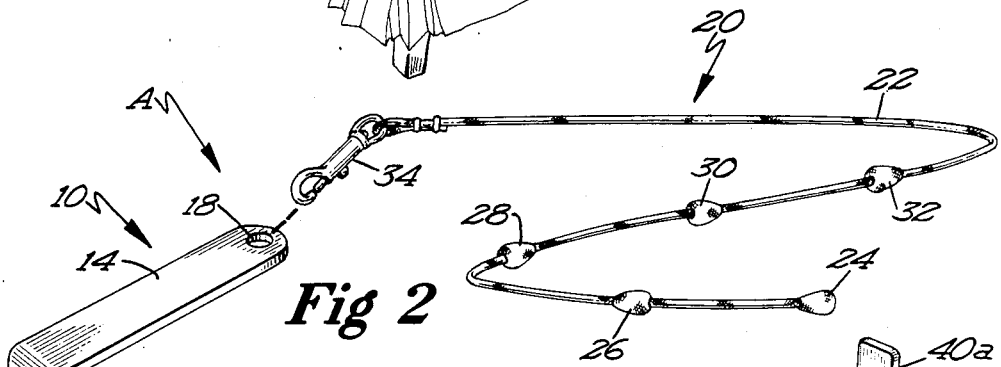
FIG. 2 is a perspective view of the device showing the tether portion removed from the rigid hook portion.

Referring to the drawings in detail, the lift device A for an incumbent person includes the substantially rigid hook member 10 which includes the central portion 12. The central portion is of a length substantially equal to the thickness of a mattress. Extending from one end of the central portion 12 and at a right angle thereto is the first or upper leg 14 and extending from the other end of the central portion is a second or lower leg 16 which extends at a right angle to the central portion and overlies the first leg in parallel relation.

The lower leg 16 is of a length greater than that of the upper leg 14. The extent of the opening of the book as defined substantially by the outer ends of the legs 16 and 14 and illustrated as O is substantially equal to the thickness of the mattress M and with such an opening and the central portion substantially equal to the thickness of the mattress, the device grippingly engages the mattress.

The outer free end of the leg 14 is formed with the hole 18. Further provided is the tether 20 formed of an elongated member 22 on which are formed the spaced extension 24, 26, 28, 30 and 32 any one of which may be gripped by the user. The inner end of the tether 20 is connected to the snap clip 34, and this snap clip is removably clipped to the outer free end of the arm 14 through the hole 18.

Figure 5:
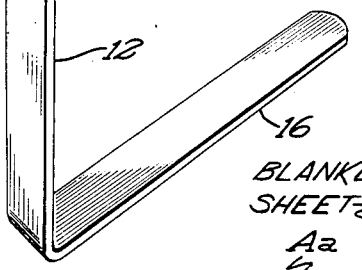
FIG. 5 is a prospective view of a leg portion of the hook member of FIG. 4.
Figure 5:
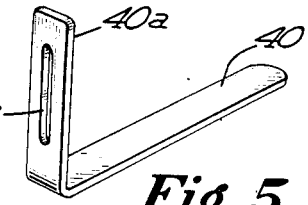
Figure 4:
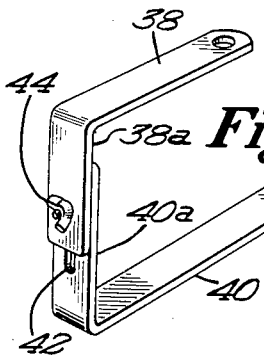
FIG. 4 is a perspective view of a further embodiment of the hook member.

In FIGS. 4 and 5 is shown a further embodiment of the hook member designated as Aa. The member Aa includes the first or upper leg 38 which has a free end portion, and at free end of the opposite end of the leg is the right angular portion 38*a*. Also included is a second or lower leg 40 which has a free end portion, and at the opposite end of the leg is the right angular portion 40*a*.

The portion 38*a* has extending freely therethrough a bolt having the wing nut 44 with the bolt having a head thereon engageable with the portion 40*a*. The bolt extends through the slot 42 formed in the portion 40*a*. The right angular portions 38*a* and 40*a* make up a central portion of the hook member Aa the length of which is adjustable by means of the nut equipped bolt and the slot 42. Thus, the hook member Aa may be adjusted to fit mattresses of various thickness if found necessary.

Figure 3:
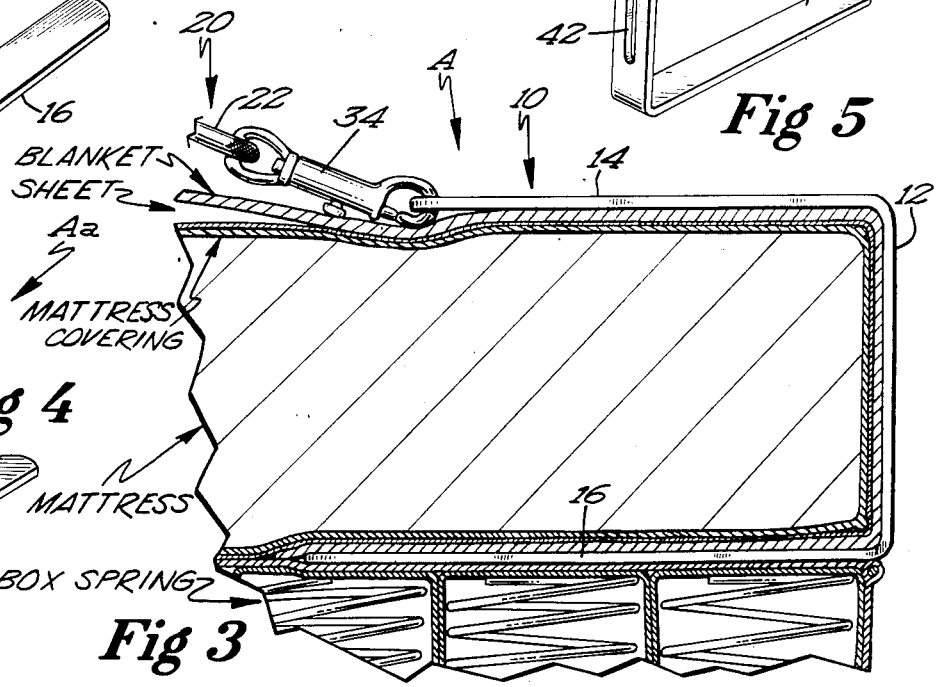
FIG. 3 is an enlarged section through a portion of the end of a mattress with the device in operative position thereon, a portion of the tether not shown.

In use the hook member 10 of the device A is slipped onto the foot end of a covered mattress such as M with the upper-arm 14 overlying and upon the blanket and sheet upon the mattress M and the lower leg in gripping engagement with the underside of the covered mattress with the central portion 12 in engagement with the covered end of the mattress, FIGS. 1 and 3, and with the hook upon the bed covering such as blanket B.

The tether 20 is caused to lie upon the blanket upon the mattress whereby it may be grasped by a person lying on the bed B at any one of the extensions 24–32 depending upon the size and reach of the patient. The incumbent person may then pull himself up to an upright sitting position, FIG. 1, whereby the person may then easily swing his legs over the side of the bed and dismount from the bed while still using the device if necessary. The device may also be used in lowering ones self from an upright position to a prone position.

While I have shown and described particular embodiments of the invention, I do not wish to limit myself to the exact forms shown, since the particular construction shown and described is intended as illustrative rather than delimitive of the invention.

I claim:

1. A lift device for an incumbent person for use with a mattress having an upper surface, an end, and an underside, with the end having a thickness dimension, comprising, in combination: means for grippingly engaging the mattress comprising a substantially rigid hook for connection with the thickness dimention of the mattress independent of any means associated with the mattress including a central portion having a length substantially equal to the thickness dimension of the mattress, a first leg extending from a first end of the central portion and having an outer free end, with the first leg tightly engaging the upper surface of the mattress, a second leg extending from an opposite end of the central portion and having an outer free end spaced from the outer free end of said first leg and forming an opening between said outer free ends of said first leg and said second leg, with the second leg tightly engaging the underside of the mattress, and with said opening of the hook formed by the outer free ends of said first and second legs being of a dimension substantially equal to the thickness dimension of the mattress; and an elongated tether connected to said first leg adjacent the outer free end thereof, with the tether being of a flexible nature throughout its length.

2. The device of claim 1 in which said tether has formed thereon at least one extension thereof for grasping by a user.

3. The device of claim 1 in which said central portion includes means for changing the length thereof.

4. The device of claim 1 wherein the first and second legs have lengths, with the length of the second leg being greater than the length of the first leg.

5. A lift device for an incumbent person for connection solely with a mattress having an upper surface, an end, and an underside, with the end having a thickness dimension, comprising, in combination: means for grippingly engaging the mattress comprising a substantially rigid hook member including a first generally straight flat strip portion having first and second ends, a second generally flat strip portion extending substantially at right angles from said first end of said first strip portion and having an outer free end, with the second strip portion tightly engaging the upper surface of the mattress, and a third generally straight flat strip portion extending generally at right angles from the second end of said first flat strip portion and in the same direction as said second strip portion extends so as to accommodate the thickness dimension of the mattress therebetween, with the second leg tightly engaging the underside of the mattress; and an elongated flexible member attached at one end to the outer free end of said second strip portion, whereby when said second strip portion underlies the underside of the mattress and a person lying on said mattress may pull himself/herself from a prone position into substantially a sitting position.

6. The device of claim 5 wherein the second and third strip portions have lengths, with the length of the third strip portion being greater than the length of the second strip portion.

7. The device of claim 5 in which (a) said first strip portion includes first and second overlapping sections, (b) said first section having a hole therein and (c) said second section having a slot therein, (d) a bolt extending through said hole and slot, whereby said first and second sections can be adjusted so that said third strip portion engages the upper surface of said mattress when said second strip portion underlies the underside of said mattress.

* * * * *